US006143713A

United States Patent [19]

Littig et al.

[11] Patent Number: 6,143,713

[45] Date of Patent: Nov. 7, 2000

[54] POLYAMINES HAVING FABRIC APPEARANCE ENHANCEMENT BENEFITS

[75] Inventors: Janet Sue Littig, Fairfield; Frederick Anthony Hartman; Ellen Schmidt Baker, both of Cincinnati, all of Ohio

[73] Assignee: The Procter & Gamble Company, Cincinnati, Ohio

[21] Appl. No.: 09/180,232

[22] PCT Filed: Apr. 25, 1997

[86] PCT No.: PCT/US97/07002

§ 371 Date: Nov. 3, 1998

§ 102(e) Date: Nov. 3, 1998

[87] PCT Pub. No.: WO97/42290

PCT Pub. Date: Nov. 13, 1997

Related U.S. Application Data

[60] Provisional application No. 60/017,061, May 3, 1996.

[51] Int. Cl.[7] ..... C11D 3/00; D06L 1/22

[52] U.S. Cl. ..... 510/520; 510/475; 8/142; 524/322

[58] Field of Search ..... 524/321, 322; 510/520, 475; 8/142; 523/102, 103

[56] References Cited

U.S. PATENT DOCUMENTS

| | | | |
|---|---|---|---|
| 3,686,025 | 8/1972 | Morton | 117/140 R |
| 3,686,128 | 8/1972 | Werdehausen et al. | 252/99 |
| 3,737,385 | 6/1973 | Werdehausen et al. | 252/102 |
| 4,238,531 | 12/1980 | Rudy et al. | 427/242 |
| 4,548,744 | 10/1985 | Connor et al. | 252/545 |
| 4,597,898 | 7/1986 | VanderMeer | 252/529 |
| 4,676,921 | 6/1987 | VanderMeer | 252/174.23 |
| 4,818,569 | 4/1989 | Trinh et al. | 427/242 |
| 4,891,160 | 1/1990 | Vander Meer | 252/541 |
| 5,686,376 | 11/1997 | Rusche et al. | 502/329 |
| 5,767,052 | 6/1998 | Shaw, Jr. et al. | 510/329 |
| 5,830,835 | 11/1998 | Severns et al. | 510/102 |

FOREIGN PATENT DOCUMENTS

| | | | |
|---|---|---|---|
| 206513 | 5/1986 | European Pat. Off. | C11D 3/30 |
| 269169 | 6/1988 | European Pat. Off. | C11D 3/386 |
| 6-299141 | 10/1994 | Japan | C09K 3/16 |
| WO93/22413 | 11/1993 | WIPO | C11D 3/37 |
| WO94/11482 | 5/1994 | WIPO | C11D 3/37 |
| WO 95/32272 | 11/1995 | WIPO | C11D 3/37 |

*Primary Examiner*—James J. Seidleck
*Assistant Examiner*—U. K. Rajguru
*Attorney, Agent, or Firm*—Richard S. Ecler, Sr.; Kim William Zerby; Jacobus C. Rasser

[57] ABSTRACT

Articles of manufacture comprising fabric appearance enhancing polyamines and methods for enhancing the appearance of fabric, said articles being applied in an automatic clothes dryer. These articles comprise:

a) a fabric treatment composition comprising:
   i) at least an effective amount of a polyamine;
   ii) at least an effective amount of a carboxylic acid carrier;
   wherein the fabric treatment composition has a viscosity of less than about 2000 centipoise at 100° C. and a melting point from about 25° C. to about 95° C.; and b) dispensing means which provides for release of an effective amount of said polyamine (i) and carboxylic acid carrier (ii) to fabrics in an automatic laundry dryer at operating temperatures.

33 Claims, No Drawings

POLYAMINES HAVING FABRIC APPEARANCE ENHANCEMENT BENEFITS

This appln is a 371 of PCT/US97/07002 filed Apr. 25, 1994 and also claims the benefit of U.S. Provisional No. 60/017,061 filed May 3, 1996.

FIELD OF THE INVENTION

The present invention relates to articles of manufacture comprising fabric appearance enhancing polyamines and methods for enhancing the appearance of fabric, said articles being applied in an automatic clothes dryer. The polyamine fabric appearance enhancers in addition to color and whiteness fidelity, also provide fabric conditioning benefits.

BACKGROUND OF THE INVENTION

Modern fabric comprises synthetic materials (e.g., Dacron), natural fibers (e.g., cotton), as well as blends thereof, however many skilled in the laundry art consider fabric to have two embodiments: white fabric and colored fabric. The consumer has long recognized the need to delineate between colored and white clothing. It was the common "wash-day" observation that many colored fabrics had a propensity to "bleed" into the laundry liquor and deposit onto other fabrics that led to the practice of sorting clothes into white fabric and colored fabric. In addition, because of problems with color fading, dyed fabric can not be laundered at the hotter water temperatures typical for whites. Once sorting became a standard practice within the laundry art, separate processes and materials evolved for cleaning these separated white and dyed fabric. The introduction of hypochlorite bleach into the laundry process, because it is not compatible with many fabric dyes, solidified the establishment of white and dyed material as the two major laundry categories.

Hypochlorites are among the most common non-surfactants used to enhance the appearance of white, non-dyed fabrics. These bleaches chemically destroy the colored stains present on white fabric and it is generally regarded that for highly conjugated, fixed stains, the first treatment with bleaching agents oxidizes the stain-producing molecules to a non-colored or less colored species that is subsequently removed in the rinse cycle. For more difficult stains, further treatment with bleach is necessary, although the over usage of bleach can damage even white fabric. The desire to enhance fabric whiteness appearance has led to the development of many adjunct laundry ingredients. One such material is optical brighteners added to reduce the yellow cast that develops on white fabrics after successive washings.

Optical brighteners have no other purpose than to enhance the appearance of fabric. Indeed, many synthetic fabrics have optical brighteners built into the fibers or fixed onto the synthetic fabric during manufacture. These additional brightening agents help to compensate in part for the yellow cast that develops when non-colored fabrics are washed in water containing heavy metal ions. However despite the use of bleaches, the incorporation of brighteners into the fabric, and other whiteness enhancing materials, some level of dinginess still persists on many white fabrics after several washings.

For colored fabrics a different set of fabric enhancement principles exists. Although dyed and white fabrics often comprise the same natural or synthetic materials, many of the dyes used to color fabrics are susceptible to the harsh bleaching conditions used to "whiten" non-dyed fabrics. The desire to remove stains from dyed fabric has provided further impetus for the development of separate non-damaging bleaching materials for colored fabrics. However, safe stain removal is only one issue that is connected to colored fabrics. Colored materials must be guarded against fading, a condition where the original color is lost due to one or more conditions. The problems of fading, change in color intensity, or color hue are even more perceptible than the "yellowing" of whites. In fact, consumers are well aware that garments comprising different materials, but having the same color, may fade at different rates in the laundry process. Therefor, non-soiled garments loose their "new" appearance simply from washing alone, and agents are needed to enhance their appearance, that is to make the fabric appear more "new-like".

Surprisingly, the materials disclosed in the present invention provide for increased color protection and appearance enhancement for both white and colored fabrics. The dinginess often described as a yellow cast, brownish discoloration, or graying that develops on white fabrics is reduced while the color fading and changing of color-hue of dyed fabrics are marginalized.

Treatment in an automatic clothes dryer has been shown to be an effective means for imparting desirable tactile properties to fabrics. For example, it is becoming common to soften fabrics in an automatic clothes dryer rather than during the rinse cycle of a laundering operation. (See U.S. Pat. No. 3,442,692, Gaiser, issued May 6, 1969, incorporated herein by reference.)

Prior to the present invention, dryer-added color protectants could suffer from uneven dispersal onto fabric and the result was a "blotchy" or "mottled" appearance. However, the modified polyamines of the present invention when formulated with a suitable carrier (e.g., stearic acid) provide an evenly applied material that serves as a color fidelity agent. The compounds useful in the compositions of the present invention are in general highly effective against the heavy metal ions responsible for color fidelity problems (e.g., copper) and against ions (e.g., manganese) that effect the dinginess of white fabrics.

Fabric "softness" is an expression well-defined in the art and is usually understood to be that quality of the treated fabric whereby its handle or texture is smooth pliable and fluffy to the touch. Various chemical compounds have long been known to possess the ability to soften fabrics when applied to them during a laundering operation.

Fabric softness also connotes the absence of static "cling" in the fabrics, and the commonly used cationic fabric softeners provide both softening and anti static benefits when applied to fabrics. Indeed, with fabrics such as nylon and polyester, the user is more able to perceive and appreciate an anti static benefit than a true softening benefit.

These dryer added fabric softener compositions typically comprise one or more cationic and/or nonionic softening and/or anti-static agents in combination with one or more conditioning agents. Typically these compositions are adapted for use by affixing the composition to an article of manufacture which serves as the means for dispensing said fabric conditioning compositions.

In addition to the fabric appearance benefits, it has now beer surprisingly found that the polyamines of the present invention when taken together with a suitable carboxylic acid carrier provide not only the surprising above-mentioned dryer-added fabric enhancement benefits but anti-static and fabric softening benefits as well. Normally anti-static and fabric softening benefits were only achievable by a combination of two or more ingredients. This combination of fabric care benefits is also deliverable without the need for other adjunct ingredients typically found in other fabric treatments. However, the polyamines of the present invention can be formulated just as well with existing fabric anti-static and conditioning compositions to provide color enhancement benefits.

U.S. Pat. Nos. 4,764,289, Trinh, issued Aug. 16, 1988 and 4,818,569, Trinh et al., issued Apr. 4, 1989 include anionic soil release polymers together with cationic and nonionic softening/anti-static agents for added fabric treatment benefits. These disclosures provide an example of the increasing benefits deliverable via the clothes dryer as more materials are formulated into the softening/anti-static compositions.

The compounds of the present invention which serve to provide fabric enhancement benefits as well as fabric anti-static and conditioning benefits are polyvinyl amines and polyalkyleneimines (PEI's) or polyalkyleneamines (PEA's). These amines can be modified by poly(alkyleneoxy) substitution of some or all polymer backbone nitrogens. These modifying polyalkoxy moieties replace the hydrogen atoms bonded to the polyamine backbone nitrogens.

BACKGROUND ART

Various references relate to polyalkyleneimines and to substituted polyalkyleneimines, see for example; U.S. Pat. No. 3,686,128, Werdehausen et al., issued Aug. 22, 1972; U.S. Pat. No. 3,737,385, Werdehausen, issued Jun. 5, 1973; U.S. Pat. No. 4,548,744, Connor, issued Oct. 22, 1985; U.S. Pat. No. 4,597,898, Vander Meer, issued Jul. 1, 1986; U.S. Pat. No. 4,676,921, issued Jun. 30, 1987; U.S. Pat. No. 4,891,160, issued Jan. 2, 1990; WO 95/32272, published Nov. 30, 1995; EP 269,169, Barrat et al., published Jun. 1, 1988; EP 206,513, Walker, published Dec. 30, 1986; and JP 06-299,141, published Oct. 25, 1994.

SUMMARY OF THE INVENTION

The present invention relates to dryer-activated compositions and articles of manufacture adapted for use to provide enhanced fabric appearance benefits in an automatic laundry dryer comprising:

a) a fabric treatment composition comprising:
   i) at least an effective amount of a polyamine;
   ii) at least an effective amount of a carboxylic acid carrier;
   wherein the fabric treatment composition has a viscosity of less than about 2000 centipoise at 100° C. and a melting point from about 25° C. to about 95° C.; and b) dispensing means which provides for release of an effective amount of said polyamine (i) and carboxylic acid carrier (ii) to fabrics in an automatic laundry dryer at operating temperatures.

It is also an object of the present invention to provide in addition to fabric appearance benefits, fabric anti-static benefits.

It is a further object of the present invention to provide fabric softening benefits in addition to fabric appearance benefits via dryer added article of manufacture.

It is still a further object of the present invention to provide a compound that is added to conventional fabric anti-static and softness compositions to provide said conventional compositions with a fabric appearance benefit added via the clothes dryer.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to dryer-activated compositions and articles of manufacture adapted for use to provide fabric appearance benefits to colored and non-colored fabric. The compositions of the present invention also provide anti-static and fabric softening benefits The fabric appearance enhancement compositions of the present invention comprise:

i) at least an effective amount of a polyamine; and ii) at least an effective amount of a carboxylic acid carrier; provided that when the polyamine (i) and the carboxylic acid carrier (ii) are combined in an effective amount the resulting fabric appearance enhancement composition must have a viscosity of less than about 2000, preferably less than 1000, more preferably less than 750, most preferably less than about 500 centipoise at 100° C. and a melting point from about 25° C. to about 95° C., preferably about 40° C. to about 95° C.

Polyamine

The present invention comprises at least an effective amount of a fabric appearance protectant comprising:

i) a polyamine having a backbone of the formula:

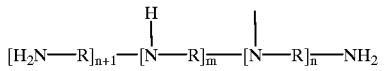

wherein R is $C_2$–$C_8$ alkylene, $C_3$–$C_8$ alkyl substituted alkylene, and mixtures thereof;

ii) a polyamine having a backbone of the formula:

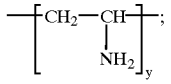

iii) optionally from 0% to 100% of the polyamine backbone NH units are substituted by one or more units having the formula:

$$-(R^1O)_xR^2$$

wherein $R^1$ is $C_2$–$C_6$ alkylene, $C_3$–$C_6$ alkyl substituted alkylene, and mixtures thereof; $R^2$ is hydrogen, $C_1$–$C_4$ alkyl, and mixtures thereof; wherein m is from 2 to about 700; n is from 0 to about 350; x is from 1 to 12, y is from 5 to 10,000.

One category of polyamine providing color appearance benefits which is suitable for use in the compositions of the present invention comprises a polyamine backbone of the formula

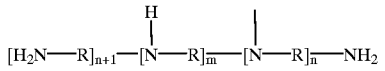

wherein the value of m is from 2 to about 700 and the value of n is from 0 to about 350. Preferably the compounds of the present invention comprise polyamines having a ratio of m:n that is at least 1:1 but may include linear polymers (n equal to 0) as well as a range as high as 10:1, preferably the ratio is 2:1. When the ratio of m:n is 2:1, the ratio of primary: secondary:tertary amine moieties, that is the ratio of —$RNH_2$, —RNH, and —RN moieties, is 1:2:1.

R units are $C_2$–$C_8$ alkylene, $C_3$–$C_8$ alkyl substituted alkylene, and mixtures thereof, preferably ethylene, 1,2-propylene, 1,3-propylene, and mixtures thereof, more preferably ethylene. R units serve to connect the amine nitrogens of the backbone.

The preferred polyamines of the present invention comprise backbones wherein less than 50% of the R groups comprise more than 3 carbon atoms. The use of two and three carbon spacers as R moieties between nitrogen atoms in the backbone is advantageous for controlling the fabric appearance enhancement properties of the molecules. More preferred embodiments of the present invention comprise less than 25% moieties having more than 3 carbon atoms. Yet more preferred backbones comprise less than 10% moieties having more than 3 carbon atoms. Most preferred backbones comprise 100% ethylene moieties.

The fabric appearance enhancing polyamines of the present invention comprise homogeneous or non-homogeneous polyamine backbones, preferably homogeneous backbones. For the purpose of the present invention the term "homogeneous polyamine backbone" is defined as a polyamine backbone having R units that are the same (i.e., all ethylene). However, this sameness definition does not exclude polyamines that comprise other extraneous units comprising the polymer backbone that are present due to an artifact of the chosen method of chemical synthesis. For example, it is known to those skilled in the art that ethanolamine may be used as an "initiator" in the synthesis of polyethyleneimines, therefore a sample of polyethyleneimine that comprises one hydroxyethyl moiety resulting from the polymerization "initiator" would be considered to comprise a homogeneous polyamine backbone for the purposes of the present invention.

For the purposes of the present invention the term "non-homogeneous polymer backbone" refers to polyamine backbones that are a composite of one or more alkylene or substituted alkylene moieties, for example, ethylene and 1,2-propylene units taken together as R units However, not all of the suitable fabric appearance enhancing agents belonging to this category of polyamine comprise the above described polyamines. Other polyamines that comprise the backbone of the compounds of the present invention are generally polyalkyleneamines (PAA's), polyalkyleneimines (PAI's), preferably polyethyleneamine (PEA's), or polyethyleneimines (PEI's). A common polyalkyleneamine (PAA) is tetrabutylenepentamine. PEA's are obtained by reactions involving ammonia and ethylene dichloride, followed by fractional distillation. The common PEA's obtained are triethylenetetramine (TETA) and tetraethylenepentamine (TEPA). Above the pentamines, i.e., the hexamines, heptamines, octamines and possibly nonamines, the cogenerically derived mixture does not appear to separate by distillation and can include other materials such as cyclic amines and particularly piperazines. There can also be present cyclic amines with side chains in which nitrogen atoms appear. See U.S. Pat. No. 2,792,372, Dickinson, issued May 14, 1957, which describes the preparation of PEA's.

The PEI's which comprise the preferred backbones of the polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing PEI's are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951 (all herein incorporated by reference). In addition to the linear and branched PEI's, the present invention also includes the cyclic amines that are typically formed as artifacts of synthesis. The presence of these materials may be increased or decreased depending on the conditions chosen by the formulator.

Other suitable polyamines for use as fabric appearance enhancement agents according to the present invention are polyvinyl amines having the formula

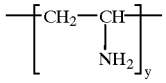

wherein y is from about 5 to about 10,000, preferably from about 10 to about 5,000, more preferably from about 20 to about 5,000.

An example of a fabric appearance enhancing polyamine comprising a PEI backbone, wherein n is 6 and m is 5 has the formula

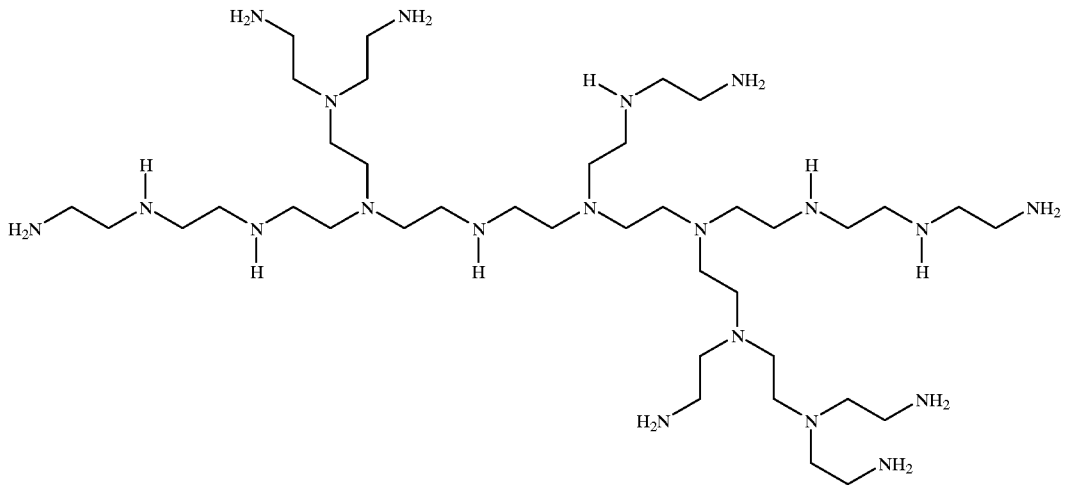

An example of a fabric appearance enhancing polyamine comprising a PEI backbone wherein n is 6 and m is 5 comprising a partial substitution of nitrogens by replacement of hydrogen with a hydroxyethyl unit, —$CH_2CH_2OH$, has the formula An example of a fabric appearance enhancing polyamine comprising a PEI backbone wherein n is 6 and m is 5 and all substitutable nitrogens are modified by replacement of hydrogen with a hydroxyethyl unit, —$CH_2CH_2OH$, has the formula

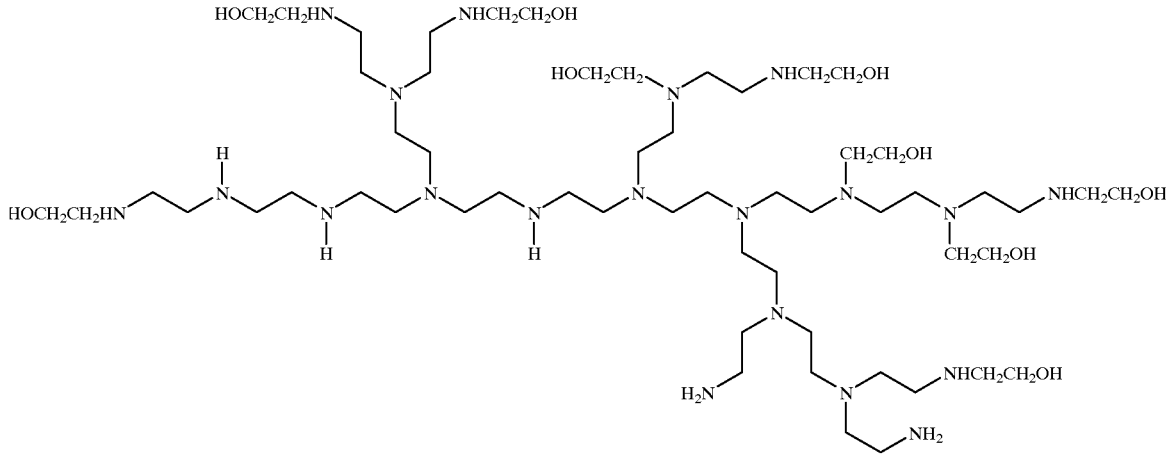

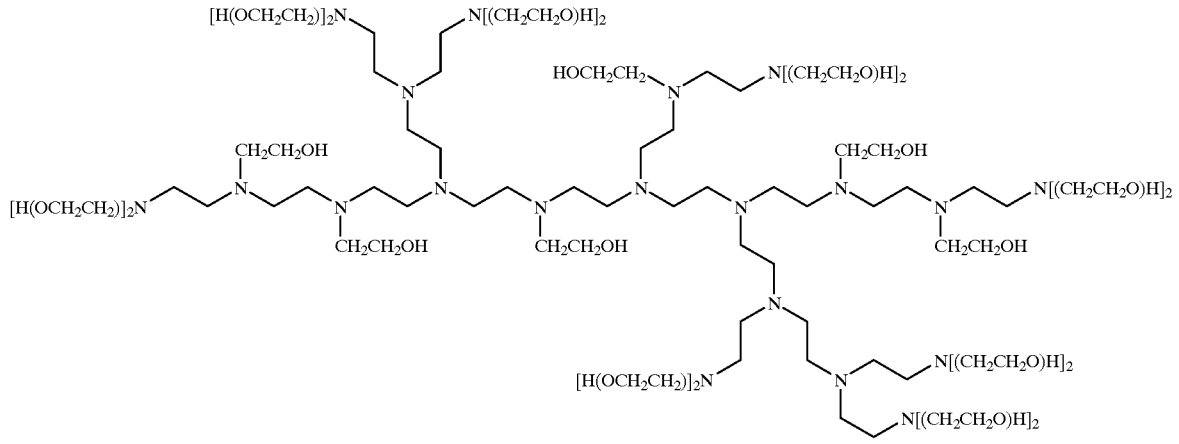

An example of a fabric appearance enhancing polyamine comprising a PEI backbone wherein n is 6 and m is 5 and all substitutable nitrogens are modified by replacement of hydrogen with a polyoxyalkyleneoxy unit, $—(CH_2CH_2O)_7H$, has the formula

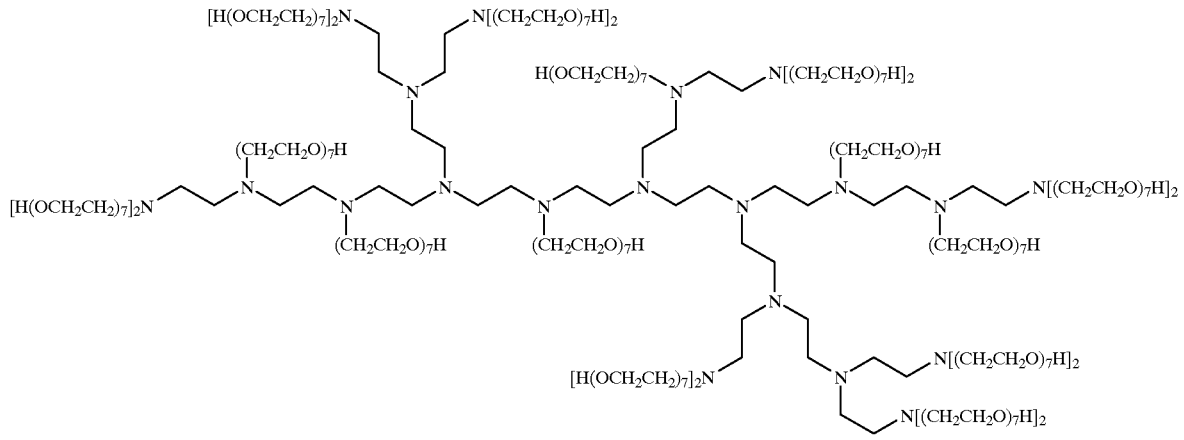

The polyamines of the present invention may develop undesirable off-colors due to impurities present as artifacts of their preparation or produced during processing or handling of the polyamines. In the case where the presence of color is unacceptable in the final formulation, the processor or formulator may apply one or more known procedures for "de-colorizing" the polyamines of the present invention. This de-colorizing may be accomplished at any stage in the processing of the polyamines disclosed herein, provided said processing does not limit or diminish the effectiveness of the final fabric appearance enhancement agents.

Carboxylic Acid Carrier

The present invention comprises at least an effective amount of a carboxylic acid carrier having the formula:

$$R^3—CO_2H$$

wherein $R^3$ is $C_2$–$C_{22}$ linear alkyl, $C_2$–$C_{22}$ branched alkyl, aryl, alkylenearyl, poly(oxyalkylene)alkyl having the formula:

$$R^4(OR^5)_zOR^6—$$

wherein $R^4$ is hydrogen, $C_1$–$C_4$ alkyl, and mixtures thereof; $R^5$ is ethylene, 1,2-propylene, and mixtures thereof; $R^6$ is $C_2$–$C_6$ linear alkyl; z is from 1 to about 20; and mixtures thereof. The carboxylic acid carrier may be a mono- or poly-carboxylic acid or the carrier may comprise mono- and polycarboxylic acids, and mixtures thereof. The poly carboxylic acids of the present invention have the general formula $$(HO_2C)_z—R^3—CO_2H$$

wherein the index z is from 1 to 3.

The term "an effective amount of a carboxylic acid carrier" is defined as the amount of carboxylic acid carrier necessary to evenly apply to the surface of fabric the polyamine. Typically this effective amount ranges from about 40% to about 99%, preferably fromabout 60% to about 95%, more preferably from 70% to about 90% by weight, of the carboxylic acid when combined with a suitable polyamine.

When the carboxylic acid carrier is combined with other adjunct ingredients which provide other fabric enhancement benefits, greater or lesser amounts of the carboxylic acid carrier may be necessary.

Suitable mono-carboxylic acids are $C_3$–$C_{23}$ linear or branched alkanoic, $C_5$–$C_{23}$ linear or branched alkenoic acids having one or more cis or trans double bonds or mixtures thereof. Examples of suitable linear or branched, alkanoic or alkenoic acids are hexanoic acid, octanoic acid, lauric acid, palmitic acid, stearic acid, oleic acid, linolenic acid, linoleic acid and elaidic acid. Preferred mono-carboxylic acids are the $C_{10}$–$C_{22}$ linear or branched alkanoic acids or $C_{16}$–$C_{20}$ alkenoic acids, more preferably linear $C_{16}$–$C_{20}$ alkanoic acids, yet more preferably a mixture of $C_{16}$–$C_{20}$ alkanoic acids, most preferably stearic acid. What is meant by "stearic acid" is any composition of alkanoic acids that comprise chemically pure $C_{18}$ alkanoic acid. Those skilled in the art recognize that "chemically pure" or "technical grade" or other similar term refers to a range of alkanoic acids, for example, stearic acid commonly comprises minor amounts of other branched and linear alkanoic acids. Further purifying said alkanoic acid carriers beyond the typical capacity of laboratory or industrial suppliers does not add to nor diminish from the suitability of said alkanoic acid carriers for the purposes of the present invention.

Suitable mono-carboxylic acids are the poly(oxyalkylene) alkanoic acids wherein $R^3$ has the formula $$R^4(OR^5)_zOR^6—$$

$R^4$ is hydrogen, $C_1$–$C_4$ alkyl, and mixtures thereof, preferably hydrogen and methyl, more preferably hydrogen; $R^5$ is ethylene, 1,2-propylene, and mixtures thereof, more preferably ethylene; $R^6$ is $C_2$–$C_6$ linear alkyl, aryl, alkylenearyl, and mixtures thereof, preferably $C_2$–$C_6$ linear alkyl, more preferably ethylene. The value of z is from 1 to about 20.

Similarly suitable for use in the compositions of the present invention are the poly carboxylic acids having the general formula $$(HO_2C)_z—R^3—CO_2H$$

wherein z is from 1 to 3. In the above formula $R^3$ is $C_2$–$C_{22}$ linear alkyl, $C_2$–$C_{22}$ branched alkyl, aryl, and alkylenearyl. However, in the case of poly carboxylic acids $R^3$ comprises from 1 to 3 additional carboxylate moieties. Examples of di-carboxylic acids are oxalic acid, malonic acid, $C_2$–$C_{22}$ linear or branched alkyl substituted malonic acid, succinic acid, $C_2$–$C_{22}$ linear or branched alkyl substituted succinic acid, glutaric acid, $C_2$–$C_{22}$ linear or branched alkyl substituted glutaric acid, adipic acid, $C_2$–$C_{22}$ linear or branched alkyl substituted adipic acid, citric acid, $C_2$–$C_9$ linear or branched alkyl substituted phthalic acid, $C_2$–$C_9$ linear or branched alkyl substituted isophthalic acid, $C_2$–$C_9$ linear or branched alkyl substituted terephthalic acid, and mixtures thereof.

Examples of substituted di-carboxylic acids include the two $C_{11}$ substituted dicarboxylic acids having the formula:

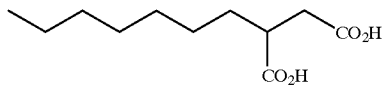

and

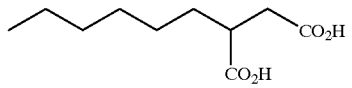

or the two branched alkyl substituted $C_{12}$ dicarboxylic acids having the formula

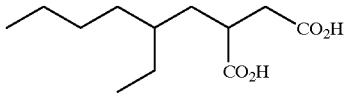

and

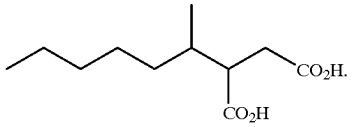

In addition, dicarboxylic acids comprising an aromatic moiety, for example the $C_9$ alkyl substituted isophthalic acid having the formula

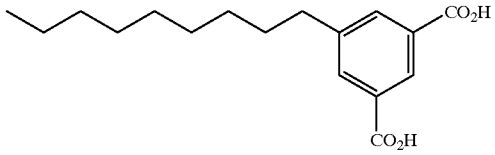

is also suitable for use as a carboxylic acid carrier according to the present invention.

A Carboxylic acid suitable for use in the present invention is 1,12-dodecanedioic acid. When defining 1,12-dodecandioc acid by the general forumula $$(HO_2C)_z—R^3—CO_2H$$

$R^3$ is $C_{10}$ and z is equal to 1.

Composition Characteristics

The compositions of the present invention must comprise at least an effective amount of a polyamine described hereinabove and an effective amount of a carboxylic acid carrier described hereinabove and the resulting composition must have a viscosity of less than about 2000, preferably less than 1000, more preferably less than 750, most preferably less than about 500 centipoise when measured at 100° C. and a melting point from about 25° C. to about 95° C., preferably about 40° C. to about 95° C. Compositions falling outside the ranges listed hereinabove for viscosity and or melting point are not effective for dispersing the polyamine/carboxylic acid combinations of the present invention for the purposes of fabric appearance enhancement. A melting point within the range of from about 25° C. to about 95° C. with a viscosity greater than 2000 centipoise at 100° C. is not suitable for use in the present invention. Likewise a composition having a viscosity less than 2000 centipoise at 100° C. but having a melting point outside the range of from about 25° C. to about 95° C. is not suitable for use in the present invention.

Embodiments of the present invention comprise fixing or attaching the compositions of the present invention to the surface of the automatic dryer drum or door. These embodiments are contemplated under the present invention provided any combination of polyamines described hereinabove and carboxylic acid carriers described hereinabove have a viscosity of less than about 2000, preferably less than 1000, more preferably less than 750, most preferably less than about 500 centipoise at 100° C. and a melting point from about 25° C. to about 95° C., preferably about 40° C. to about 95° C. The combinations described may be applied to the surface of the automatic dryer drum, door or other surface including an article of manufacture or by any convenient applicator.

For the purposes of the present invention the term "effective amount" is the amount of polyamine present in combination with a suitable carrier that imparts enhanced fabric appearance benefits. The amount of polyamine needed to enhance the appearance of fabric differs from embodiment to embodiment, however, typical examples of compositions effective in consumer laundry applications are described in the examples herein below.

For the purposes of the present invention the term "fabric appearance enhancement" is taken to mean that when an article of fabric which after laundering is subsequently treated with the dryer-added compositions of the present invention is then compared to a similar fabric article not treated with the compositions of the present invention, that the treated article will more closely resemble the fabric when it was new. This applies equally as well to white fabric as well as to dyed or colored fabric.

Another embodiment of the present invention relates to the combination of the polyamines and optionally the carboxylic acid carriers of the present invention with other ingredients which provide fabric enhancement benefits other than appearance benefits, for example, anti-static benefits, fabric softness benefits, and fabric damage prevention benefits. One example of this embodiment is to add a suitable amount of the polyamine to a standard dryer-added composition having fabric softeness benefits. These optional fabric enhancement ingredients are listed herein below.

In the case of embodiments wherein the polyamines and carboxylic acid carriers are added to other fabric conditioning compositions, the amount of fabric conditioning composition necessary for combination with the polyamines and carboxylic acids, is "an effective amount" of fabric conditioning composition. For the purposes of the present invention the term "an effective amount" of fabric conditioning composition is that amount necessary to provide an anti-static benefit, a softness benefit or other fabric benefit typical of fabric conditioning compositions.

OPTIONAL FABRIC CONDITIONING AGENTS AND ADJUNCTS

Adjunct Cationic Conditioning Agents

Compositions of the present invention can contain from about 5% to about 95%, preferably from about 15% to about 90%, more preferably from about 25% to about 85%, and even more preferably from about 25% to about 55%, of biodegradable cationic softener, preferably an ester quaternary ammonium compound (EQA).

The optional fabric conditioning component is preferably a fabric softening compound which is an ester quaternary ammonium (EQA) compound or its precursor amine having the formula:

$$[(R^1)_{4-p}—N^+—((CH_2)_v—Y—R^2)_p]X^- \qquad \text{Formula I}$$

wherein Y is a carboxy moiety having the formula $$—O—\overset{\overset{\displaystyle O}{\|}}{C}— \quad \text{or} \quad —\overset{\overset{\displaystyle O}{\|}}{C}—O—;$$

the index p is from 1 to 3; the index v is from 1 to 4, and mixtures thereof; $R^1$ is $C_1$–$C_6$ alkyl, $C_1$–$C_4$ hydroxy alkyl group, or benzyl, preferably $C_1$–$C_3$ alkyl, for example, methyl, ethyl, propyl, most preferred is methyl; preferably one $R^1$ moiety is a short chain alkyl group, preferably methyl; $R^2$ is $C_8$–$C_{30}$ saturated alkyl or $C_8$–$C_{30}$ unsaturated alkyl, $C_8$–$C_{30}$ substituted alkyl or $C_8$–$C_{30}$ unsubstituted alkyl, preferably $C_{14}$–$C_{18}$ saturated alkyl or $C_{14}$–$C_{18}$ unsaturated alkyl, $C_{14}$–$C_{18}$ substituted alkyl or $C_{14}$–$C_{18}$ unsubstituted alkyl, more preferably linear $C_{14}$–$C_{18}$ saturated alkyl, wherein each $R^2$ moiety suitable for use has an Iodine Value of from about 3 to about 60; the counter ion, $X^-$, can be any softener-compatible anion, preferably methylsulfate, ethylsulfate, chloride, bromide, formate, sulfate, lactate, nitrate, benzoate, more preferably methylsulfate.

Tallow is a convenient and inexpensive source of long chain alkyl and alkenyl materials.

It will be understood that substituents $R^1$ and $R^2$ of Formula I can optionally be substituted with various groups such as alkoxyl or hydroxyl groups. The preferred compounds can be considered to be diester (DEQA) variations of ditallow dimethyl ammonium methyl sulfate (DTDMAMS), which is a widely used fabric softener. At least 80% of the DEQA is in the diester form, and from 0% to about 20%, preferably less than about 10%, more preferably less than about 5%, can be EQA monoester (e.g., only one —Y—$R^2$ group).

The following are non-limiting examples of EQA Formula I (wherein all long-chain alkyl substituents are straight-chain):

Saturated $[C_2H_5]_2{}^+N[CH_2CH_2OC(O)C_{17}H_{35}]_2\ (CH_3SO_4)^-$
$[CH_3][C_2H_5]^+N[CH_2CH_2OC(O)C_{13}H_{27}]_2\ [HC(O)O]^-$
$[C_3H_7][C_2H_5]^+N[CH_2CH_2OC(O)C_{11}H_{23}]_2\ (CH_3SO_4)^-$
$[CH_3]_2{}^+N—[CH_2CH_2OC(O)C_{17}H_{35}]CH_2CH_2OC(O)C_{15}H_{31}\ (CH_3SO_4)^-$
$[CH_3]_2{}^+N[CH_2CH_2OC(O)R^2]_2\ (CH_3SO_4)^-$
where —$C(O)R^2$ is derived from saturated tallow.

Unsaturated $[CH_3]_2{}^+N[CH_2CH_2OC(O)C_{17}H_{33}]_2\ (CH_3SO_4)^-$
$[C_2H_5]_2{}^+N[CH_2CH_2OC(O)C_{17}H_{33}]_2\ Cl^-$
$[CH_3][C_2H_5]^+N[CH_2CH_2OC(O)C_{13}H_{25}]_2\ [C_6H_5C(O)O]^-$
$[CH_3]_2{}^+N—[CH_2CH_2OC(O)C_{17}H_{33}]CH_2CH_2OC(O)C_{15}H_{29}\ (CH_3CH_2SO_4)^-$
$[CH_3]_2{}^+N[CH_2CH_2OC(O)R^2]_2\ (CH_3SO_4)^-$
where —$C(O)R^2$ is derived from partially hydrogenated tallow or modified tallow having the characteristics set forth herein.

Other specific examples of biodegradable Formula I compounds suitable for use in the fabric softening compositions herein are:

N-methyl-N,N-di-(2-$C_{14}$–$C_{18}$-acyloxy ethyl);
N-2-hydroxyethyl ammonium methylsulfate;
$[HOCH(CH_3)CH_2][CH_3]^+N[CH_2CH_2OC(O)C_{15}H_{31}]_2\ Br^-$;
$[HOCH(CH_3)CH_2][CH_3]^+N[CH_2CH_2OC(O)C_{15}H_{29}]_2\ [HC(O)O]^-$; and
$[CH_2CH_2OH][CH_3]^+N[CH_2CH_2OC(O)R^2]_2\ (CH_3SO_4)^-$. A preferred compound is N-methyl, N,N-di-(2-oleyloxyethyl) N-2-hydroxyethyl ammonium methylsulfate.

Further suitable fabric softening compounds are quaternary ammonium compounds having the formula:

$$[(R^1)_{4-p}—N^+—((CH_2)_v—Y''—R^2)_p]X^- \qquad \text{Formula II}$$

wherein Y" is a carboxy moiety having the formula

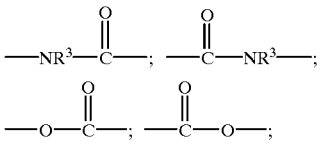

and mixtures thereof, wherein at least one Y" group is

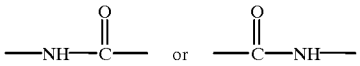

the index p is from 1 to 3; the index v is from 1 to 4, and mixtures thereof; $R^1$ is $C_1$–$C_6$ alkyl or benzyl, preferably $C_1$–$C_3$ alkyl, for example, methyl, ethyl, propyl, most preferred is methyl; preferably one $R^1$ moiety is a short chain alkyl group, preferably methyl; $R^2$ is $C_8$–$C_{30}$ saturated alkyl or $C_8$–$C_{30}$ unsaturated alkyl, $C_8$–$C_{30}$ substituted alkyl or $C_8$–$C_{30}$ unsubstituted alkyl, preferably $C_{14}$–$C_{18}$ saturated alkyl or $C_{14}$–$C_{18}$ unsaturated alkyl, $C_{14}$–$C_{18}$ substituted alkyl or $C_{14}$–$C_{18}$ unsubstituted alkyl, more preferably linear $C_{14}$–$C_{18}$ saturated alkyl, wherein each $R^2$ moiety suitable for use has an Iodine Value of from about 3 to about 60; $R^3$ is R or H; the counter ion, $X^-$, can be any softener-compatible anion, preferably methylsulfate, ethylsulfate, chloride, bromide, formate, sulfate, lactate, nitrate, benzoate, more preferably methylsulfate.

It will be understood that substituents R and $R^2$ of Formula II can optionally be substituted with various groups such as alkoxyl or hydroxyl groups.

The preferred ester linked compounds (DEQA) can be considered to be diester variations of ditallow dimethyl ammonium chloride (DTDMAC), which is a widely used fabric softener. Preferably, at least 80% of the DEQA is in the diester form, and from 0% to about 20%, preferably less than about 10%, more preferably less than about 5%, can be DEQA monoester (e.g., only one —Y—$R^2$ group). For optimal antistatic benefit monoester should be low, preferably less than about 2.5%. The level of monoester can be controlled in the manufacturing of the DEQA.

The quaternary softening compounds with at least partially unsaturated alkyl or acyl groups have advantages (i.e., antistatic benefits) and are highly acceptable for consumer products when certain conditions are met. Antistatic effects are especially important where the fabrics are dried in a tumble dryer, and/or where synthetic materials which generate static are used. Any reference to IV values hereinafter refers to IV of fatty alkyl or acyl groups and not to the resulting quaternary, e.g., DEQA compound. As the IV is raised, there is a potential for odor problems.

For unsaturated softener actives, the optimum storage temperature for stability and fluidity depends on the specific IV of, e.g., the fatty acid used to make DEQA and/or the level/type of solvent selected. Exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

The following are non-limiting examples of DEQA Formula II (wherein all long-chain alkyl substituents are straight-chain):

Saturated $[C_2H_5]_2^{(+)}N[CH_2CH_2OC(O)C_{17}H_{35}]_2\ SO_4CH_3^{(-)}$
$[C_3H_7][C_2H_5]^{(+)}N[CH_2CH_2OC(O)C_{11}H_{23}]_2\ SO_4^{(-)}CH_3$
$[CH_3]_2^{(+)}N[CH_2CH_2OC(O)R^2]_2\ SO_4CH_3^{(-)}$
where —$C(O)R^2$ is derived from saturated tallow.

Unsaturated $[CH_3]_2^{(+)}N[CH_2CH_2OC(O)C_{17}H_{33}]_2\ SO_4^{(-)}CH_3$
$[C_2H_5]_2^{(+)}N[CH_2CH_2OC(O)C_{17}H_{33}]_2\ Cl^{(-)}$
$[CH_2CH_2OH][CH_3]^{(+)}N[CH_2CH_2OC(O)R^2]_2\ CH_3SO_4^{(-)}$
$[CH_3]_2^{(+)}N[CH_2CH_2OC(O)R^2]_2\ CH_3SO_4^{(-)}$
where —$C(O)R^2$ is derived from partially hydrogenated tallow or modified tallow having the characteristics set forth herein.

Further suitable fabric softening compounds according to the present invention are ester quaternary ammonium compounds having the formula:

Formula III

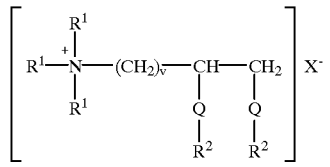

wherein Q is a carboxy moiety having the formula

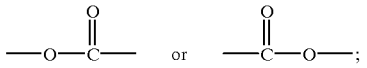

the index v is from 1 to 4, and mixtures thereof; $R^1$ is $C_1$–$C_4$ allyl, $C_1$–$C_4$ hydroxy alkyl group, preferably methyl; preferably one $R^1$ moiety is a short chain alkyl group, preferably methyl; $R^2$ is $C_8$–$C_{30}$ saturated alkyl or $C_8$–$C_{30}$ unsaturated alkyl, $C_8$–$C_{30}$ substituted alkyl or $C_8$–$C_{30}$ unsubstituted alkyl, preferably $C_{14}$–$C_{18}$ saturated alkyl or $C_{14}$–$C_{18}$ unsaturated alkyl, $C_{14}$–$C_{18}$ substituted alkyl or $C_{14}$–$C_{18}$ unsubstituted alkyl, more preferably linear $C_{14}$–$C_{18}$ saturated alkyl, wherein each $R^2$ moiety suitable for use has an Iodine Value of from about 3 to about 60; the counter ion $X^-$ is methylsulfate.

An example of the above described ester quaternary ammonium compound which is suitable for use as a fabric softening compound in the present invention is 1,2-bis(tallowyloxy)-3-trimethyl ammoniopropane methylsulfate (DTTMAPMS). Other suitable examples are 1,2-bis(cocoyloxy)-3-trimethyl ammoniopropane methylsulfate, 1,2-bis(lauryloxy)-3-trimethyl ammoniopropane methylsulfate, 1,2-bis(oleyloxy)-3-trimethyl ammoniopropane methylsulfate and 1,2-bis(stearyloxy)-3-trimethyl ammoniopropane methylsulfate. Replacing one or more or the methyl moieties in the above examples with ethyl, propyl, isopropyl, butyl, isobutyl, or mixtures thereof, result in suitable fabric softening compounds according to the present invention. In addition, other anions other than methylsulfate may be used.

Other examples of suitable Formula III EQA compounds of this invention are obtained by, e.g., replacing "tallowyl" in the above compounds with, for example, cocoyl, lauryl, oleyl, stearyl, palmityl, or the like; replacing "methyl" in the above compounds with ethyl, propyl, isopropyl, butyl, isobutyl, t-butyl, or the hydroxy substituted analogs of these radicals; replacing "methylsulfate" in the above compounds with chloride, ethylsulfate, bromide, formate, sulfate, lactate, nitrate, and the like, but methylsulfate is preferred.

Yet still further suitable fabric softening compounds according to the present invention are ester quaternary ammonium compounds having the formula:

Formula IV

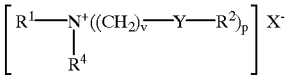

wherein Y is a carboxy moiety having the formula

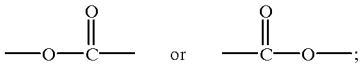

the index p is 2; the index v is from 1 to 4, and mixtures thereof; $R^1$ is $C_1$–$C_4$ alkyl or hydroxy alkyl, preferably $C_1$–$C_3$ alkyl, for example, methyl, ethyl, propyl, most preferred is methyl; $R^2$ is $C_8$–$C_{30}$ saturated or unsaturated, substituted or unsubstituted alkyl having an Iodine Value of from about 3 to about 60, preferred $R^2$ is $C_8$–$C_{14}$ linear or branched alkyl, more preferred $C_8$–$C_{14}$ linear alkyl; $R^4$ is a $C_1$–$C_4$ alcohol; the counter ion, $X^-$, can be any softener-compatible anion, preferably methylsulfate, ethylsulfate, chloride, bromide, formate, sulfate, lactate, nitrate, benzoate, more preferably methylsulfate.

Most preferably, the quaternary ammonium compound is a fully saturated compound, such as dimethyl bis (tallowyloxyethyl) ammonium methylsulfate, derived from hardened tallow. Also suitable are dimethyl bis (acyloxyethyl) ammonium methylsulfate derivatives of $C_8$–$C_{30}$ fatty acids, such as dimethyl bis(tallowyloxyethyl) ammonium methylsulfate; dimethyl bis(oleyloxyethyl) ammonium methylsulfate or dimethyl bis(cocoyloxyethyl) ammonium methylsulfate. The composition of the present invention may comprise from about 15% to about 90% of these quaternary ammonium compounds.

An example of the above described ester quaternary ammonium compounds suitable for use as a fabric softening compound according to the present invention is N-methyl-N,N-bis-(2-$C_{14}$–$C_{18}$-acyloxy)ethyl-N-2-hydroxyethyl ammonium methylsulfate. A preferred example is N-methyl-N,N-bis(2-oleyloxyethyl)-N-(2-hydroxyethyl) ammonium methylsulfate.

The fabric conditioning composition can be any of those known in the art and/or previously disclosed by others in patent applications. Compositions that are suitable are disclosed in U.S. Pat. Nos. 3,944,694, McQueary; 4,073,996, Bedenk et al.; 4,237,155, Kardouche; 4,711,730, Gosselink et al.; 4,749,596, Evans et al.; 4,808,086, Evans et al.; 4,818,569, Trinh et al.; 4,877,896, Maldonado et al.; 4,976,879, Maldonado et al.; 5,041,230, Borcher, Sr. et al.; 5,094,761, Trinh et al.; 5,102,564, Gardlik et al.; and 5,234,610, Gardlik et al., all of said patents being incorporated herein by reference.

The compounds herein can be prepared by standard esterification and quaternization reactions, using readily available starting materials. General methods for preparation are disclosed in U.S. Pat. No. 4,137,180, incorporated herein by reference.

As used herein, when the diester quat is specified, it will include the monoester quat that is normally present. For the optimal antistatic benefit the percentage of monoester quat should be as low as possible, preferably less than about 20%. The level of monoester quat present can be controlled in the manufacturing of the EQA.

EQA compounds prepared with fully saturated acyl groups are rapidly biodegradable and excellent softeners. However, it has been discovered that compounds prepared with at least partially unsaturated acyl groups have advantages (i.e., antistatic benefits) and are highly acceptable for consumer products when certain conditions are met.

Variables that must be adjusted to obtain the benefits of using unsaturated acyl groups include the Iodine Value (IV) of the fatty acids, the odor of fatty acid starting material, and/or the EQA. Any reference to IV values herein refers to IV of fatty acyl groups and not to the resulting EQA compound.

Antistatic effects are especially important where the fabrics are dried in a tumble dryer, and/or where synthetic materials which generate static are used. As the IV is raised, there is a potential for odor problems.

Some highly desirable, readily available sources of fatty acids such as tallow, possess odors that remain with the compound EQA despite the chemical and mechanical processing steps which convert the raw tallow to finished EQA. Such sources must be deodorized, e.g., by absorption, distillation (including stripping such as steam stripping), etc., as is well known in the art. In addition, care should be taken to minimize the adverse results of contact of the resulting fatty acyl groups with oxygen and/or bacteria by adding antioxidants, antibacterial agents, etc. The additional expense and effort associated with the unsaturated fatty acyl groups is justified by the superior performance.

Generally, hydrogenation of fatty acids to reduce polyunsaturation and to lower IV to insure good color and odor stability leads to a high degree of trans configuration in the molecule. Therefore, diester compounds derived from fatty acyl groups having low IV values can be made by mixing fully hydrogenated fatty acid with touch hydrogenated fatty acid at a ratio which provides an IV of from about 3 to about 60. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc.

It has also been found that for good chemical stability of the diester quaternary compound in molten storage, water levels in the raw material must be minimized to preferably less than about 1% and more preferably less than about 0.5%. Storage temperatures should be kept as low as possible and still maintain a fluid material, ideally in the range of from about 49° C. to about 75° C. The optimum storage temperature for stability and fluidity depends on the specific IV of the fatty acid used to make the diester quaternary and the level/type of solvent selected. Also, exposure to oxygen should be minimized to keep the unsaturated groups from oxidizing. It can therefore be important to store the material under a reduced oxygen atmosphere such as a nitrogen blanket. It is important to provide good molten storage stability to provide a commercially feasible raw material that will not degrade noticeably in the normal transportation/storage/handling of the material in manufacturing operations.

Adjunct fabric softening compositions employed herein contain as an optional component, at a level of from about 0% to about 95%, preferably from about 20% to about 75%, more preferably from about 20% to about 60%, a carboxylic acid salt of a tertiary amine and/or ester amine which has the formula:

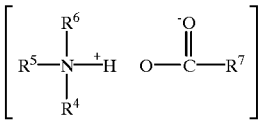

wherein $R^5$ is a long chain aliphatic group containing from about 8 to about 30 carbon atoms; $R^4$ and $R^6$ are the same or different and are independently selected from the group consisting of aliphatic groups containing from about 1 to about 30 carbon atoms, hydroxyalkyl groups of the formula $R^8OH$ wherein $R^8$ is an alkylene group of from about 2 to about 30 carbon atoms, and polyalkyleneoxy moieties of the formula $R^9O(R^{10}O)_m$— wherein $R^9$ is hydrogen, $C_1$–$C_{30}$ alkyl, $C_1$–$C_{30}$ alkenyl, and mixtures thereof; $R^{10}$ is ethylene, 1,2 propylene, 1,3-propylene, and mixtures thereof; m is from about 2 to about 10; wherein further the $R^4$, $R^5$, $R^6$, $R^8$, and $R^9$ chains can be ester interrupted groups; and wherein $R^7$ is selected from the group consisting of $C_2$–$C_{30}$ linear alkyl, $C_2$–$C_{30}$ linear alkenyl, $C_8$–$C_{30}$ aryl, $C_8$–$C_{30}$ alkylaryl, and $C_8$–$C_{30}$ arylalkyl; substituted $C_1$–$C_{30}$ linear alkyl, $C_1$–$C_{30}$ linear alkenyl, $C_8$–$C_{30}$ aryl, $C_8$–$C_{30}$ alkylaryl, and $C_8$–$C_{30}$ arylalkyl wherein the substituents are selected from the group consisting of halogen, carboxyl, and hydroxyl, said composition having a thermal softening point of from about 35° C. to about 100° C.

Preferably, $R^5$ is an aliphatic chain containing from about $C_{12}$–$C_{30}$ linear alkyl, $R^6$ is $C_{12}$–$C_{30}$ linear alkyl, and $R^4$ is $C_1$–$C_{30}$ linear alkyl.

Examples of preferred tertiary amines as starting material for the reaction between the amine and carboxylic acid to form the tertiary amine salts are: lauryldimethylamine, myristyldimethylamine, stearyldimethylamine, tallowdimethylamine, coconutdimethylamine, dilaurylmethylamine, distearylmethylamine, ditallowmethylamine, oleyldimethylamine, dioleylmethylamine, lauryldi(3-hydroxypropyl)amine, stearyldi(2-hydroxyethyl)amine, trilaurylamine, laurylethylmethylamine, and

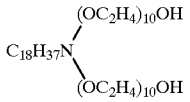

Preferred fatty acids are those wherein $R^7$ is $C_8$–$C_{30}$ linear alkyl, more preferably $C_{11}$–$C_{17}$ linear alkyl.

Examples of specific carboxylic acids as a starting material are: formic acid, acetic acid, lauric acid, myristic acid, palmitic acid, stearic acid, oleic acid, oxalic acid, adipic acid, 12-hydroxy stearic acid, benzoic acid, 4-hydroxy benzoic acid, 3-chloro benzoic acid, 4-nitro benzoic acid, 4-ethyl benzoic acid, 4-(2-chloroethyl)benzoic acid, phenylacetic acid, (4-chlorophenyl)acetic acid, (4-hydroxyphenyl) acetic acid, and phthalic acid.

Preferred carboxylic acids are stearic, oleic, lauric, myristic, palmitic, and mixtures thereof.

The amine salt can be formed by a simple addition reaction, well known in the art, disclosed in U.S. Pat. No. 4,237,155, Kardouche, issued Dec. 2, 1980, which is incorporated herein by reference. Excessive levels of free amines may result in odor problems, and generally free amines provide poorer softening performance than the amine salts.

Preferred amine salts for use herein as optional ingredients are those wherein the amine moiety is a $C_8$–$C_{30}$ alkyl or alkenyl dimethyl amine or a di-$C_8$–$C_{30}$ alkyl or alkenyl methyl amine, and the acid moiety is a $C_8$–$C_{30}$ alkyl or alkenyl monocarboxylic acid. The amine and the acid, respectively, used to form the amine salt will often be of mixed chain lengths rather than single chain lengths, since these materials are normally derived from natural fats and oils, or synthetic processed which produce a mixture of chain lengths. Also, it is often desirable to utilize mixtures of different chain lengths in order to modify the physical or performance characteristics of the softening composition.

Specific preferred amine salts for use in the present invention are oleyldimethylamine stearate, stearyldimethylamine stearate, stearyldimethylamine myristate, stearyldimethylamine oleate, stearyldimethylamine palmitate, distearylmethylamine palmitate, distearylmethylamine laurate, and mixtures thereof. A particularly preferred mixture is oleyldimethylamine stearate and distearylmethylamine myristate, in a ratio of 1:10 to 10:1, preferably about 1:1.

Adjunct Nonionic Conditioning Agents

An optional softening agent of the present invention is a nonionic fabric softener material. Typically, such nonionic fabric softener materials have an HLB of from about 2 to about 9, more typically from about 3 to about 7. In general, the materials selected should be relatively crystalline, higher melting, (e.g., >25° C.).

The level of optional nonionic softener in the solid composition is typically from about 10% to about 50%, preferably from about 15% to about 40%.

Preferred nonionic softeners are fatty acid partial esters of polyhydric alcohols, or anhydrides thereof, wherein the alcohol, or anhydride, contains from about 2 to about 18, preferably from about 2 to about 8, carbon atoms, and each fatty acid moiety contains from about 8 to about 30, preferably from about 12 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan.

The fatty acid portion of the ester is normally derived from fatty acids having from about 8 to about 30, preferably from about 12 to about 22, carbon atoms. Typical examples of said fatty acids being lauric acid, myristic acid, palmitic acid, stearic acid, oleic acid, and behenic acid.

Highly preferred optional nonionic softening agents for use in the present invention are $C_{10}$–$C_{26}$ acyl sorbitan esters and polyglycerol monostearate. Sorbitan esters are esterified dehydration products of sorbitol. The preferred sorbitan ester comprises a member selected from the group consisting of $C_{10}$–$C_{26}$ acyl sorbitan monoesters and $C_{10}$–$C_{26}$ acyl sorbitan diesters and ethoxylates of said esters wherein one or more of the unesterified hydroxyl groups in said esters contain from 1 to about 6 oxyethylene units, and mixtures thereof. For the purpose of the present invention, sorbitan esters containing unsaturation (e.g., sorbitan monooleate) can be utilized.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide, fatty acid ester, and/or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties (Tweens®) are also useful in the composition of the present invention. Therefore, for purposes of the present invention, the term "sorbitan ester" includes such derivatives.

The material which is sold commercially as sorbitan mono-ester (e.g., monostearate) does in fact contain significant amounts of di- and tri-esters and a typical analysis of sorbitan monostearate indicates that it comprises about 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid, ester, or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or inter-esterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include mono-esters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

The dryer activated fabric softening compositions of the present invention may further includes a co-softener. The co-softener may comprise a carboxylic acid salt of a tertiary amine, tertiary amine ester, or mixtures thereof. The carboxylic acid salt forming anion moiety of the co-softener may be selected from the group consisting of lauric, myristic, palmitic, stearic, oleic and mixtures thereof. The amine salt of the co-softener may be selected from the group consisting of oleyldimethylamine stearate, dioleylmethylamine stearate, linoleyldimethylamine stearate, dilinoleylmethylamine stearate, stearyldimethylamine stearate, distearylmethylamine myristate, stearyldimethylamine palmitate, distearylmethylamine palmitate, distearylmethylamine myristate, distearylmethylamine palmitate, distearylmethylamine laurate, dioleyldistearylmethylamine oleate, distearylmethyl-amine oleate, and mixtures thereof.

Optional Cyclodextrin/Perfume Complexes and Free Perfume

The products herein can also contain from about 0.5% to about 60%, preferably from about 1% to about 50%, cyclodextrin/perfume inclusion complexes and/or free perfume, as disclosed in U.S. Pat. Nos. 5,139,687, Borcher et al., issued Aug. 18, 1992; and 5,234,610, Gardlik et al., to issue Aug. 10, 1993, which are incorporated herein by reference. Perfumes are highly desirable, can usually benefit from protection, and can be complexed with cyclodextrin. Fabric softening products typically contain perfume to provide an olfactory aesthetic benefit and/or to serve as a signal that the product is effective.

The optional perfume ingredients and compositions of this invention are the conventional ones known in the art. Selection of any perfume component, or amount of perfume, is based solely on aesthetic considerations. Suitable perfume compounds and compositions can be found in the art including U.S. Pat. Nos. 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference. Many of the art recognized perfume compositions are relatively substantive to maximize their odor effect on substrates. However, it is a special advantage of perfume delivery via the perfume/cyclodextrin complexes that nonsubstantive perfumes are also effective.

If a product contains both free and complexed perfume, the escaped perfume from the complex contributes to the overall perfume odor intensity, giving rise to a longer lasting perfume odor impression.

As disclosed in U.S. Pat. No. 5,234,610, Gardlik/Trinh/Banks/Benvegnu, issued Aug. 3, 1993, said patent being incorporated herein by reference, by adjusting the levels of free perfume and perfume/CD complex it is possible to provide a wide range of unique perfume profiles in terms of timing (release) and/or perfume identity (character). Solid, dryer-activated fabric conditioning compositions are a uniquely desirable way to apply the cyclodextrins, since they are applied at the very end of a fabric treatment regimen when the fabric is clean and when there are almost no additional treatments that can remove the cyclodextrin.

Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.05% to about 0.1% for antioxidants and more preferably from about 0.01% to about 0.2% for reductive agents. These assure good odor stability under long term storage conditions for the compositions. Use of antioxidants and reductive agent stabilizers is especially advantageous for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT, BHA, propyl gallate, and citric acid available from Eastman Chemicals Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA.

Examples of reductive agents include sodium borohydride, hypophosphorous acid, and mixtures thereof.

Other Adjunct Ingredients

The present invention can include other adjunct components (minor components) conventionally used in textile treatment compositions, for example, colorants, perfumes, perfume systems, preservatives, optical brighteners, opacifiers, stabilizers such as guar gum and polyethylene glycol, anti-shrinkage agents, anti-wrinkle agents, fabric crisping agents, spotting agents, germicides, fungicides, anti-corrosion agents, antifoam agents, and the like.

SUBSTRATE ARTICLES

In preferred embodiments, the present invention encompasses articles of manufacture. Representative articles are those that are adapted to soften fabrics in an automatic laundry dryer, of the types disclosed in U.S. Pat. No. 3,989,631, Marsan, issued Nov. 2, 1976; U.S. Pat. No. 4,055,248, Marsan, issued Oct. 25, 1977; U.S. Pat. No. 4,073,996, Bedenk et al., issued Feb. 14, 1978; U.S. Pat. No. 4,022,938, Zaki et al., issued May 10, 1977; U.S. Pat. No. 4,764,289, Trinh, issued Aug. 16, 1988; U.S. Pat. No. 4,808,086, Evans et al., issued Feb. 28, 1989; U.S. Pat. No. 4,000,340, Murphy et al., issued Dec. 28, 1976; U.S. Pat. No. 4,103,047, Zaki et al., issued Jul. 25, 1978; U.S. Pat. No. 3,736,668, Dillarstone, issued Jun. 5, 1973; U.S. Pat. No. 3,701,202, Compa et al., issued Oct. 31, 1972; U.S. Pat. No. 3,634,947, Furgal, issued Jan. 18, 1972; U.S. Pat. No. 3,633,538, Hoeflin, issued Jan. 11, 1972; U.S. Pat. No. 3,435,537, Rumsey, issued Apr. 1, 1969; all of which are incorporated herein by reference.

The fabric treatment compositions can be employed by simply adding a measured amount into the dryer, e.g., as liquid dispersion. In a preferred substrate article embodiment, the fabric treatment compositions are provided as an article of manufacture in combination with a dispensing means such as a flexible substrate which effectively releases the composition in an automatic laundry (clothes) dryer. Such dispensing means can be designed for single usage or for multiple uses. The dispensing means can also be a "material" that releases the fabric softener composition and then is dispersed and/or exhausted from the dryer.

A highly preferred article herein comprises the fabric treatment composition releasably affixed to a flexible substrate in a sheet configuration. Highly preferred paper, woven or nonwoven "absorbent" substrates useful herein are fully disclosed in U.S. Pat. No. 3,686,025, Morton, issued Aug. 22, 1972, incorporated herein by reference. It is known that most substances are able to absorb a liquid substance to some degree; however, the term "absorbent" as used herein, is intended to mean a substance with an absorbent capacity (i.e., a parameter representing a substrate's ability to take up and retain a liquid) from 4 to 12, preferably, 5 to 7, times its weight of water.

Determination of absorbent capacity values is made by using the capacity testing procedures described in U.S. Federal Specification UU-T-595b, modified as follows:

1. tap water is used instead of distilled water;
2. the specimen in immersed for 30 seconds instead of 3 minutes;
3. draining time is 15 seconds instead of 1 minute; and
4. the specimen is immediately weighed on a torsion balance having a pan with turned-up edges.

Absorbent capacity values are then calculated in accordance with the formula given in said Specification. Based on this test, one-ply, dense bleached paper (e.g., kraft or bond having a basis eight of about 32 pounds per 3,000 square feet) has an absorbent capacity of 3.5 to 4, commercially available household one-ply toweling paper has a value of 5 to 6; and commercially available two-ply household toweling paper has a value of 7 to about 9.5.

Using a substrate with an absorbent capacity of less than 4 tends to cause too rapid release of the fabric treatment composition from the substrate resulting in several disadvantages, one of which is uneven conditioning of the fabrics. Using a substrate with an absorbent capacity over 12 is undesirable, inasmuch as too little of the fabric treatment composition is released to condition the fabrics in optimal fashion during a normal drying cycle.

Such a substrate comprises a nonwoven cloth having an absorbent capacity of preferably from about 5 to 7 and wherein the weight ratio of fabric treatment composition to substrate on a dry weight basis ranges from about 5:1 to 1:1.

Non-woven cloth substrate preferably comprises cellulosic fibers having a length of from 3/16 inch to 2 inches a denier of from 1.5 to 5 and the substrate is adhesively bonded together with a binder resin.

The flexible substrate preferably has openings sufficient in size and number to reduce restriction by said article of the flow of air through an automatic laundry dryer. The better openings comprise a plurality of rectilinear slits extended along one dimension of the substrate.

Use of the Article of Manufacture

The dispensing means will normally carry an effective amount of fabric treatment composition. Such effective amount typically provides sufficient fabric conditioning agent and/or anionic polymeric soil release agent for at least one treatment of a minimum load in an automatic laundry dryer. Amounts of fabric treatment composition for multiple uses, e.g., up to about 30, can be used. Typical amounts for a single article can vary from about 0.25 g to about 100 gm.

One such article comprises sponge material releasably enclosing enough fabric treatment composition to effectively impart fabric soil release and softness benefits during several cycles of clothes. This multi-use article can be made by filling a hollow sponge with about 20 gms of the fabric treatment composition.

The substrate embodiment of this invention can be used for imparting the above-described fabric treatment composition to fabric to provide softening and/or antistatic effects together with color fidelity benefits to fabric in an automatic laundry dryer. Generally, the method of using the composition of the present invention comprises: commingling pieces of damp fabric by tumbling said fabric under heat in an automatic clothes dryer with an effective amount of the fabric treatment composition.

The following examples illustrate the esters and compositions of this invention, but are not intended to be limiting thereof.

EXAMPLE 1

Preparation of PEI 1800 $E_1$

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

A 1800 g portion of polyethyleneimine (PEI) (Nippon Shokubai, Epomin SP-018 having a listed average molecular weight of 1800 equating to about 1.0 mole of polymer and 41.7 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 1800 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

The reaction mixture is then deodorized by passing about 100 cu. ft. of inert gas (argon or nitrogen) through a gas dispersion frit and through the reaction mixture while agitating and heating the mixture to 130° C.

Note: This procedure can be adapted to the preparation of mono-ethoxylated polyamines by adjusting the relative amounts of ethylene oxide.

EXAMPLE 2

Preparation of PEI 1800 $E_7$

The ethoxylation is conducted in a 2 gallon stirred stainless steel autoclave equipped for temperature measurement and control, pressure measurement, vacuum and inert gas purging, sampling, and for introduction of ethylene oxide as a liquid. A ~20 lb. net cylinder of ethylene oxide (ARC) is set up to deliver ethylene oxide as a liquid by a pump to the autoclave with the cylinder placed on a scale so that the weight change of the cylinder could be monitored.

Step 1.

A 750 g portion of polyethyleneimine (PEI) (Nippon Shokubai, Epomin SP-018 having a listed average molecular weight of 1800 equating to about 0.417 moles of polymer and 17.4 moles of nitrogen functions) is added to the autoclave. The autoclave is then sealed and purged of air (by applying vacuum to minus 28" Hg followed by pressurization with nitrogen to 250 psia, then venting to atmospheric pressure). The autoclave contents are heated to 130° C. while applying vacuum. After about one hour, the autoclave is charged with nitrogen to about 250 psia while cooling the autoclave to about 105° C. Ethylene oxide is then added to the autoclave incrementally over time while closely monitoring the autoclave pressure, temperature, and ethylene oxide flow rate. The ethylene oxide pump is turned off and cooling is applied to limit any temperature increase resulting from any reaction exotherm. The temperature is maintained between 100 and 110° C. while the total pressure is allowed to gradually increase during the course of the reaction. After a total of 750 grams of ethylene oxide has been charged to the autoclave (roughly equivalent to one mole ethylene oxide per PEI nitrogen function), the temperature is increased to 110° C. and the autoclave is allowed to stir for an additional hour. At this point, vacuum is applied to remove any residual unreacted ethylene oxide.

Next, vacuum is continuously applied while the autoclave is cooled to about 50° C. while introducing 376 g of a 25% sodium methoxide in methanol solution (1.74 moles, to achieve a 10% catalyst loading based upon PEI nitrogen functions). The methoxide solution is sucked into the autoclave under vacuum and then the autoclave temperature controller setpoint is increased to 130° C. A device is used to monitor the power consumed by the agitator. The agitator power is monitored along with the temperature and pressure. Agitator power and temperature values gradually increase as methanol is removed from the autoclave and the viscosity of the mixture increases and stabilizes in about 1 hour indicating that most of the methanol has been removed. The mixture is further heated and agitated under vacuum for an additional 30 minutes.

Step 2.

Vacuum is removed and the autoclave is cooled to 105° C. while it is being charged with nitrogen to 250 psia and then vented to ambient pressure. The autoclave is charged to 200 psia with nitrogen. Ethylene oxide is again added to the autoclave incrementally as before while closely monitoring the autoclave pressure, temperature, and ethylene oxide flow rate while maintaining the temperature between 100 and 110° C. and limiting any temperature increases due to reaction exotherm. After the addition of 4500 g of ethylene oxide (resulting in a total of 7 moles of ethylene oxide per mole of PEI nitrogen function) is achieved over several hours, the temperature is increased to 110° C. and the mixture stirred for an additional hour. The reaction mixture is then collected in nitrogen purged containers and eventually transferred into a 22 L three neck round bottomed flask equipped with heating and agitation. The strong alkali catalyst is neutralized by adding 167 g methanesulfonic acid (1.74 moles). The reaction mixture is then deodorized by passing about 100 cu. ft of inert gas (argon or nitrogen) through a gas dispersion frit and through the reaction mixture while agitating and heating the mixture to 130° C.

Note: This procedure can be adapted to the preparation of poly-ethoxylated polyamines by adjusting the relative amounts of ethylene oxide used in Steps 1 and 2.

EXAMPLE 3

Ethoxylation of Poly(ethyleneimine) with Average Molecular Weight of 1,200

To a 250 ml 3-neck round bottom flask equipped with a Claisen head, thermometer connected to a temperature controller (Therm-O-Watch™, $I^2R$), sparging tube, and mechanical stirrer is added poly(ethyleneimine) MW 1200 (Polysciences, 50.0 g, 0.042 mole). Ethylene oxide gas (Liquid Carbonics) is added via the sparging tube under argon at approximately 140° C. with very rapid stirring until a weight gain of 34 g (corresponding to 1.2 ethoxy units) is obtained. To the reaction solution is added potassium hydroxide pellets (Baker, 0.30 g, 0.0053 mol). after the potassium hydroxide dissolves, ethylene oxide is added as described above until a weight gain of 60 g (corresponding to a total of 4.2 ethoxy units) is obtained. A 53 g portion of this brown viscous liquid is saved. Ethylene oxide is added to the remaining material as described above until a weight gain of 35.9 g (corresponding to a total of 7.1 ethoxy units) is obtained to afford 94.9 g of dark brown liquid. The potassium hydroxide in the latter two samples is neutralized by adding the theoretical amounts of methanesulfonic acid.

Compositions of the present invention suitable for use includes the following.

EXAMPLES 4–9

| | Weight % | | | | | |
|---|---|---|---|---|---|---|
| Ingredients | 4 | 5 | 6 | 7 | 8 | 9 |
| PEI 1800 $E_1$[1] | 10.0 | 8.0 | — | — | — | — |
| PEI 1800 $E_7$[2] | — | 2.0 | — | — | — | — |
| PEI 1200 $E_1$[3] | — | — | 8.0 | — | — | — |
| PEI 1200 $E_5$[4] | — | — | 2.0 | — | — | — |
| Polyvinyl amine A[5] | — | — | — | 10.0 | 5.0 | — |
| Polyvinyl amine B[6] | — | — | — | — | 5.0 | — |
| Polyvinyl amine C[7] | — | — | — | — | — | 10.0 |
| Stearic Acid | 90.0 | 90.0 | 90.0 | 90.0 | 90.0 | 90.0 |

[1]According to Example 1 above.
[2]According to Example 2 above.
[3]According to Example 3 above.
[4]Prepared by modification of the procedure described in Example 2 above.
[5]Polyvinyl amine having a MW = 83,500.
[6]Polyvinyl amine having a MW = 491,000.
[7]Polyvinyl amine having a MW range of 50–100,000.

EXAMPLES 10–15

| | Weight % | | | | | |
|---|---|---|---|---|---|---|
| Ingredients | 10 | 11 | 12 | 13 | 14 | 15 |
| PEI 1800 $E_1$[1] | 5.0 | 10. | 20.0 | 30.0 | 10.0 | 5.0 |
| Stearic Acid | 47.5 | 45.0 | 80.0 | — | 80.0 | 95.0 |
| Oleic Acid | 47.5 | 45.0 | — | 70.0 | 10.0 | — |

[1]According to Example 1 above.

EXAMPLES 16–21

| | Weight % | | | | | |
|---|---|---|---|---|---|---|
| Ingredients | 16 | 17 | 18 | 19 | 20 | 21 |
| PEI 1800 $E_1$[1] | 5.0 | 10. | 20.0 | 30.0 | 10.0 | 5.0 |
| Palmitic Acid | 85.0 | 80.0 | 80.0 | 70.0 | 80.0 | 95.0 |
| 1,12-dodecandioc Acid | 10.0 | 10.0 | — | — | 10.0 | — |

[1]According to Example 1 above.

A dryer added fabric conditioner formula includes the following.

| | Weight % | | | | |
|---|---|---|---|---|---|
| Ingredients | 22 | 23 | 24 | 25 | 26 |
| DEQA[1] | 39.16 | 24.79 | — | — | — |
| DEQA[2] | — | — | 21.81 | — | — |
| DTDMAMS[3] | — | — | — | 18.64 | 11.94 |
| Co-Softener[4] | 34.41 | 28.16 | 21.33 | 28.04 | 21.52 |
| Glycosperse S-20[5] | — | — | 12.38 | — | — |
| Glycerol Monostearate | — | — | — | 18.87 | 13.23 |
| Clay[6] | 4.02 | 4.02 | 3.16 | 3.91 | 3.90 |
| Perfume system[7] | 0.7 | 1.1 | — | — | — |
| Perfume system[8] | — | — | 0.7 | 1.6 | — |
| Perfume system[9] | — | — | — | — | 2.6 |
| PEI 1800 $E_7$[10] | 2.1 | 5.3 | 4.1 | 2.2 | 5.2 |
| Steric acid | balance | balance | balance | balance | balance |

[1]Di-(oleyloxyethyl) dimethyl ammonium methylsulfate
[2]Di-(soft-tallowyloxyethyl) hydroxyethyl methyl ammonium methylsulfate
[3]Ditallow dimethyl ammoniun methylsulfate
[4]1:2 Ratio of stearyldimethyl amine:triple-pressed stearic acid
[5]Polyethoxylated sorbitan monostearate , available from Lonza
[6]Calcium Bentonite Clay, Bentonite L, sold by Southern Clay Products
[7]Free perfume system.
[8]Cyclodextrin bound perfume system.
[9]Pro-perfume system.
[10]According to Example 1.

The following are examples wherein the modified polyamines of the present invention are added to typical dryer-added compositions. The resulting compositions have increased fabric enhancement benefits over the base formulation.

| | Weight % | | | | |
|---|---|---|---|---|---|
| Ingredients | 27 | 28 | 29 | 30 | 31 |
| DTDMAMS[1] | 45.00 | 45.00 | 45.00 | 62.00 | 60.00 |
| Co-Softener[2] | 24.3 | 24.3 | 24.3 | — | — |
| Glycosperse S-20[3] | 13.5 | 13.5 | 13.5 | — | — |

-continued

| Ingredients | Weight % | | | | |
|---|---|---|---|---|---|
| | 27 | 28 | 29 | 30 | 31 |
| Glycerol Monostearate | — | — | — | — | — |
| Clay[4] | 2.70 | 2.70 | 2.70 | — | — |
| Perfume system[5] | 1.00 | 1.00 | 1.00 | 2.00 | 2.40 |
| Perfume system[6] | 1.00 | 1.00 | 1.00 | — | — |
| PEI 1800 $E_1$[7] | — | 12.5 | 6.25 | — | — |
| PEI 1800 $E_7$[8] | 12.5 | — | 6.25 | 10.0 | 15.0 |
| Stearic acid | — | — | — | balance | balance |

[1]Ditallow dimethyl ammonium methylsulfate
[2]1:2 Ratio of stearyldimethyl amine:triple-pressed stearic acid
[3]Polyethoxylated sorbitan monostearate, available from Lonza
[4]Calcium Bentonite Clay, Bentonite L, sold by Southern Clay Products
[5]Free perfume system.
[6]Cyclodextrin bound perfume system.
[7]According to Example 1.
[8]According to Example 2.

What is claimed is:

1. An article of manufacture adapted for use to provide fabric appearance benefits in an automatic laundry dryer comprising:

a) a fabric treatment composition comprising:
i) at least an effective amount of a polyamine;
ii) at least an effective amount of a carboxylic acid carrier;
wherein the fabric treatment composition has a viscosity of less than about 2000 centipoise at 100° C. and a melting point from about 25° C. to about 95° C.; and b) dispensing means which provides for release of an effective amount of said polyamine (i) and carboxylic acid carrier (ii) to fabrics in an automatic laundry dryer at operating temperatures.

2. An article of manufacture according to claim 1 wherein fabric treatment composition (a) comprises:

i) from about 1% to about 60% by weight, of a polyamine;
ii) from about 40% to about 99% by weight, of a carrier comprising one or more carboxylic acids; and dispensing means (b) is a flexible substrate.

3. An article of manufacture according to claim 1 wherein the polyamine comprises:

i) a polyamine having a backbone of the formula:

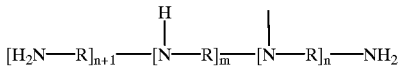

wherein R is $C_2$–$C_8$ alkylene, $C_3$–$C_8$ alkyl substituted alkylene, and mixtures thereof; m is from 2 to about 700; n is from 0 to about 350;

ii) a polyamine having a backbone of the formula:

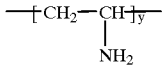

wherein y is from 5 to about 10,000; and iii) optionally from 0% to 100% of the polyamine backbone NH units are substituted by one or more units having the formula:

$$—(R^1O)_xR^2$$

wherein $R^1$ is $C_2$–$C_6$ alkylene, $C_3$–$C_6$ alkyl substituted alkylene, and mixtures thereof; $R^2$ is hydrogen, $C_1$–$C_4$ alkyl, and mixtures thereof; x is from 1 to 12.

4. An article of manufacture according to claim 3 comprising a modified polyamine wherein R is ethylene, 1,2-propylene, 1,3-propylene, and mixtures thereof.

5. An article of manufacture according to claim 4 comprising a modified polyamine wherein R is ethylene.

6. An article of manufacture according to claim 1 wherein the polyamine backbone NH hydrogens are replaced by one or more units having the formula:

$$—(R^1O)_xR^2$$

wherein $R^1$ is $C_2$–$C_6$ alkylene, $C_3$–$C_6$ alkyl substituted alkylene, and mixtures thereof; $R^2$ is hydrogen, $C_1$–$C_4$ alkyl, and mixtures thereof.

7. An article of manufacture according to claim 6 wherein $R^1$ is ethylene, 1,2-propylene, 1,3-propylene, and mixtures thereof.

8. An article of manufacture according to claim 7 wherein $R^1$ is ethylene.

9. An article of manufacture according to claim 6 wherein $R^2$ is hydrogen or methyl.

10. An article of manufacture according to claim 6 wherein x is from about 1 to about 7.

11. An article of manufacture according to claim 10 wherein x is from about 1 to about 4.

12. An article of manufacture according to claim 1 wherein from about 5% to about 100% of the polyamine backbone NH units are substituted.

13. An article of manufacture according to claim 12 wherein from about 25% to about 100% of the polyamine backbone NH units are substituted.

14. An article of manufacture according to claim 13 wherein from about 50% to about 100% of the polyamine backbone NH units are substituted.

15. An article of manufacture according to claim 3 wherein y is from 10 to 5000.

16. An article of manufacture according to claim 3 wherein n is from 0 to about 200.

17. An article of manufacture according to claim 16 wherein n is from 0 to about 20.

18. An article of manufacture according to claim 3 wherein m is from 2 to about 200.

19. An article of manufacture according to claim 18 wherein m is from 4 to about 50.

20. An article of manufacture according to claim 1 wherein the carboxylic acid carrier is a mono-carboxylic acid or a poly-carboxylic acid.

21. An article of manufacture according to claim 1 comprising a mono-carboxylic acid carrier having the formula:

$$R^3—CO_2H$$

wherein $R^3$ is $C_2$–$C_{22}$ linear alkyl, $C_2$–$C_{22}$ branched alkyl, aryl, alkylenearyl, poly(oxyalkylene)alkyl having the formula:

$$R^4(OR^5)_zOR^6—$$

wherein $R^4$ is hydrogen, $C_1$–$C_4$ alkyl, and mixtures thereof; $R^5$ is ethylene, 1,2-propylene, and mixtures thereof; $R^6$ is $C_2$–$C_6$ linear alkyl; z is from 1 to about 20; and mixtures thereof.

22. An article of manufacture according to claim 21 wherein the mono-carboxylic acid is $C_6$–$C_{22}$ linear, $C_6$–$C_{22}$ branched alkanoic acid, and mixtures thereof.

23. An article of manufacture according to claim 22 wherein the mono-carboxylic acid is $C_{12}$–$C_{22}$ linear, $C_{12}$–$C_{22}$ branched alkanoic acid, and mixtures thereof.

24. An article of manufacture according to claim 23 wherein the mono-carboxylic acid is $C_{16}$–$C_{22}$ linear alkanoic acid, and mixtures thereof.

25. An article of manufacture according to claim 1 wherein the poly-carboxylic acid is selected from the group consisting of oxalic acid, malonic acid, $C_2$–$C_{22}$ linear or branched alkyl substituted malonic acid, succinic acid, $C_2$–$C_{22}$ linear or branched alkyl substituted succinic acid, glutaric acid, $C_2$–$C_{22}$ linear or branched alkyl substituted glutaric acid, adipic acid, $C_2$–$C_{22}$ linear or branched alkyl substituted adipic acid, citric acid, $C_2$–$C_9$ linear or branched alkyl substituted phthalic acid, $C_2$–$C_9$ linear or branched alkyl substituted isophthalic acid, $C_2$–$C_9$ linear or branched alkyl substituted terephthalic acid, and mixtures thereof.

26. An article of manufacture according to claim 1 wherein the fabric treatment composition has a viscosity of less than about 1000 centipoise at 100° C.

27. An article of manufacture according to claim 26 wherein the fabric treatment composition has a viscosity of less than about 750 centipoise at 100° C.

28. An article of manufacture according to claim 27 wherein the fabric treatment composition has a viscosity of less than about 500 centipoise at 100° C.

29. An article of manufacture according to claim 1 wherein the fabric treatment composition has a melting point of from about 40° C. to about 95° C.

30. An article of manufacture adapted for use to provide fabric appearance benefits in an automatic laundry dryer comprising:

a) a fabric treatment composition comprising:

i) an effective amount of a polyamine selected from the group consisting of:

1) a polyamine having a backbone of the formula:

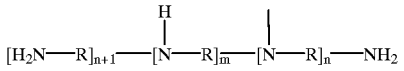

wherein R is $C_2$–$C_8$ alkylene, $C_3$–$C_8$ alkyl substituted alkylene, and mixtures thereof;

2) a polyamine having a backbone of the formula:

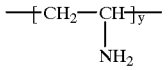

wherein y is from 5 to about 10,000; and 3) optionally from 0% to 100% of the polyamine backbone NH units are substituted by one or more units having the formula:

$$—(R^1O)_xR^2$$

wherein $R^1$ is $C_2$–$C_6$ alkylene, $C_3$–$C_6$ alkyl substituted alkylene, and mixtures thereof; $R^2$ is hydrogen, $C_1$–$C_4$ alkyl, and mixtures thereof; wherein m is from 2 to about 700; n is from 0 to about 350; x is from 1 to 12, y is from 5 to 5000;

ii) an effective amount of a fabric conditioning composition; and ii) adjunct ingredients; wherein the fabric treatment composition has a viscosity of less than about 2000 centipoise at 100° C. and a melting point from about 25° C. to about 95° C.; and b) dispensing means which provides for release of an effective amount of said polyamine (i), fabric treatment composition (ii) and adjunct ingredients (iii) to fabrics in an automatic laundry dryer at operating temperatures.

31. An article of manufacture according to claim 30 comprising:

a) a fabric treatment composition comprising:

i) from about 1% to about 60% by weight, of a polyamine;

ii) from about 0% to about 99% by weight, of a carboxylic acid carrier;

iii) from about 1% to about 99% by weight, of a fabric conditioning composition; and iv) adjunct ingredients wherein the fabric treatment composition has a viscosity of less than about 2000 centipoise at 100° C. and a melting point from about 25° C. to about 95° C.; and b) dispensing means which provides for release of an effective amount of said polyamine (i), carboxylic acid carrier (ii), fabric treatment composition (iii) and adjunct ingredients (iv) to fabrics in an automatic laundry dryer at operating temperatures.

32. An article of manufacture according to claim 31 wherein the fabric conditioning composition comprises an ester quaternary ammonium compound selected from the group consisting of:

a) ester quaternary ammonium compounds having the formula $$[(R^1)_{4-p}—N^+—((CH_2)_v—Y—R^2)_p]X^-$$

wherein Y is —O—(O)C— or —C(O)—O—; p is 1 to 3; v is from 1 to 4; $R^1$ is $C_1$–$C_6$ alkyl $C_1$–$C_4$ hydroxy alkyl group, benzyl, and mixtures thereof; $R^2$ is $C_8$–$C_{30}$ saturated alkyl, $C_8$–$C_{30}$ unsaturated alkyl, $C_8$–$C_{30}$ substituted alkyl, $C_8$–$C_{30}$ unsubstituted alkyl, and mixtures thereof; $X^-$ is a softener-compatible anion;

b) ester quaternary ammonium compounds having the formula $$[(R^1)_{4-p}—N^+—((CH_2)_v—Y''—R^2)_p]X^-$$

wherein Y" is a carboxy moiety having the formula

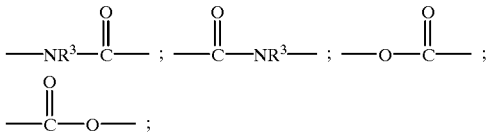

and mixtures thereof, wherein at least one Y" group is

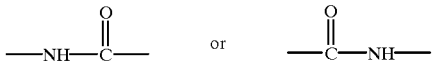

the index p is from 1 to 3; the index v is from 1 to 4, and mixtures thereof; $R^1$ is $C_1$–$C_6$ alkyl, benzyl, and mixtures thereof; $R^2$ is $C_8$–$C_{30}$ saturated alkyl, $C_8$–$C_{30}$ unsaturated alkyl, $C_8$–$C_{30}$ substituted alkyl, $C_8$–$C_{30}$ unsubstituted alkyl, and mixtures thereof wherein each $R^2$ moiety suitable for use has an Iodine Value of from about 3 to about 60; $R^3$ is hydrogen, R, and mixtures thereof; $X^-$ is a softener-compatible anion;

c) ester quaternary ammonium compounds having the formula

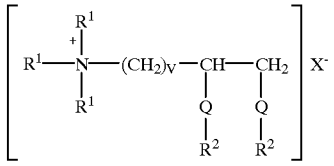

wherein the index v is from 1 to 4, and mixtures thereof; $R^1$ is $C_1$–$C_4$ alkyl, $C_1$–$C_4$ hydroxy alkyl group, and mixtures thereof; $R^2$ is $C_8$–$C_{30}$ saturated alkyl, $C_8$–$C_{30}$ unsaturated alkyl, $C_8$–$C_{30}$ substituted alkyl, $C_8$–$C_{30}$ unsubstituted alkyl, and mixtures thereof, wherein each $R^2$ moiety has an Iodine Value of from about 3 to about 60; $X^-$ is methylsulfate;

d) ester quaternary ammonium compounds having the formula

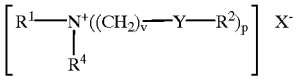

the index v is from 1 to 4, and mixtures thereof; p has the value 2; $R^1$ is $C_1$–$C_4$ alkyl, $C_1$–$C_4$ hydroxy alkyl group, and mixtures thereof; $R^2$ is $C_8$–$C_{30}$ saturated alkyl, $C_8$–$C_{30}$ unsaturated alkyl, $C_8$–$C_{30}$ substituted alkyl, $C_8$–$C_{30}$ unsubstituted alkyl, and mixtures thereof, wherein each $R^2$ moiety has an Iodine Value of from about 3 to about 60; wherein each $R^2$ moiety suitable for use has an Iodine Value of from about 3 to about 60; $X^-$ is a softener-compatible anion;

and mixtures thereof.

33. An article of manufacture according to claim 32 wherein the ester quaternary ammonium compound is selected from the group consisting of dimethyl bis(tallowyl oxy ethyl) ammonium methyl sulfate; dimethyl bis(oleyl oxy ethyl) ammonium methyl sulfate; dimethyl bis(cocoyl oxy ethyl) ammonium methyl sulfate, and mixtures thereof.

* * * * *